US005443713A

United States Patent [19]

Hindman

[11] Patent Number: 5,443,713

[45] Date of Patent: Aug. 22, 1995

[54] THIN-FILM STRUCTURE METHOD OF FABRICATION

[75] Inventor: Gregory T. Hindman, Albany, Oreg.

[73] Assignee: Hewlett-Packard Corporation, Palo Alto, Calif.

[21] Appl. No.: 336,355

[22] Filed: Nov. 8, 1994

[51] Int. Cl.[6] ..... C25D 1/10

[52] U.S. Cl. ..... 205/70; 205/75; 430/18

[58] Field of Search ..... 205/75, 70, 122; 430/18; 204/192

[56] References Cited

U.S. PATENT DOCUMENTS 4,229,265 10/1980 Kenworthy ..... 204/11
4,773,971 9/1988 Lam et al. ..... 204/11
4,839,001 6/1989 Bakewell ..... 204/11
4,954,225 9/1990 Bakewell ..... 204/11
5,255,017 10/1993 Lam ..... 205/75

*Primary Examiner*—John Niebling
*Assistant Examiner*—Brendan Mee

[57] ABSTRACT

A process for fabricating a thin-film structure using a transparent substrate is disclosed. A first structure, such as a ring, is formed of a dielectric material on a conductive material layer. The conductive material is partially removed, such as within the center of the ring structure. A photoresist material pillar is formed to fill the center of the ring structure, protruding above the ring structure rim. Such structures are useful as mandrel structures in the forming of precision components, such as nozzle plates, mesh ink filter screens, and the like, for ink-jet pens.

22 Claims, 6 Drawing Sheets

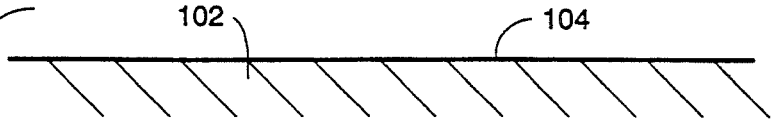
FIG. 1A
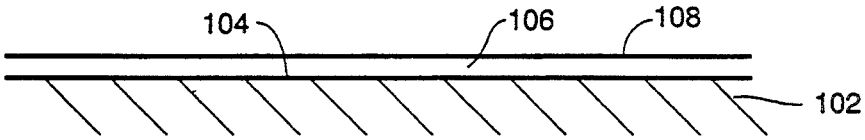
FIG. 1B
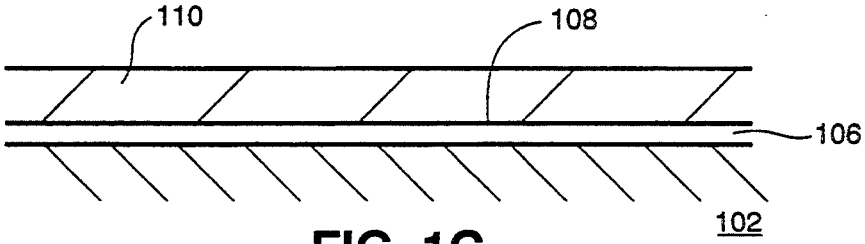
FIG. 1C
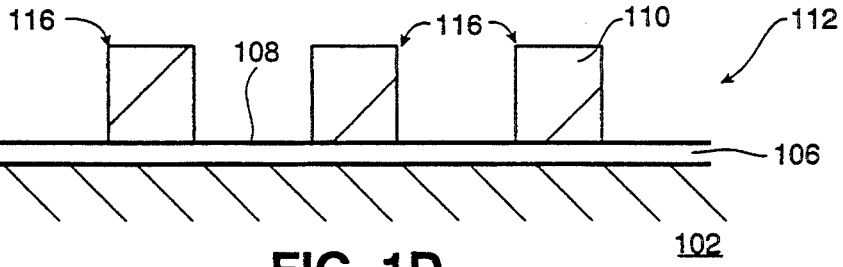
FIG. 1D
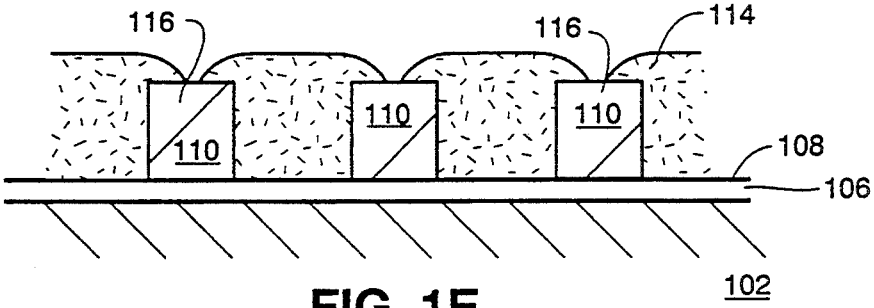
FIG. 1E
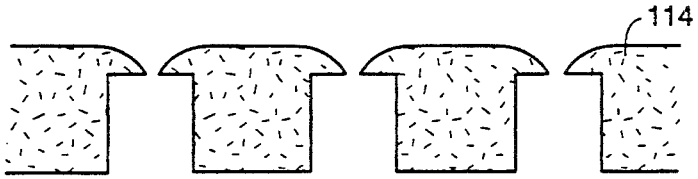
FIG. 1F
FIG. 1
(Prior Art)

THIN-FILM STRUCTURE METHOD OF FABRICATION

CROSS-REFERENCE TO RELATED PATENTS AND APPLICATIONS

This application is related to the subject matter disclosed in the following U.S. Patents and U.S. Patent Applications, all of which are assigned to the assignee of the present invention:

U.S. patent application Ser. No. 08/336,405, filed on the same date as the present application by Kenneth Trueba for a SELF-ALIGNED THIN-FILM STRUCTURE METHOD OF FABRICATION, incorporated herein by reference in its entirety.

BACKGROUND OF THE INVENTION

1. Field of the Invention The present invention relates generally to thin-film manufacturing techniques and, more specifically, to a fabricating process used to produce thin-film mandrel structures useful for electroforming ink-jet pen components.

2. Description of the Related Art

As is well-known to persons skilled in the art, many publications describe the details of common techniques used in thin-film fabrication processes. Reference to general texts, such as Silicon Processing for the VLSI Era by Stanley Wolf and Richard Tauber, copyright 1986, Lattice Press publishers, and VLSI Technology, S. M. Sze editor, copyright 1986, McGraw-Hill publishers (each incorporated herein by reference in pertinent parts), is recommended, as those techniques can be generally used in the present invention. Moreover, the individual steps of such processes can be performed using commercially available integrated circuit fabrication machines.

The an of ink-jet technology is also relatively well developed. Commercial products such as computer printers, graphics plotters, and facsimile machines employ ink-jet technology to produce hard copy. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions, incorporated herein by reference.

The state of the art is continually developing to improve the quality of the fundamental dot matrix form of printing intrinsic to ink-jet technology. Current products have achieved print densities of up to 1200 dots-per-inch ("DPI"), achieving print quality comparable to the more expensive laser printers. To that end, thin-film technology has been employed to produce precision components such as orifice plates, fine mesh ink filters, and the like, for ink-jet pens.

A standard manufacturing process for producing mandrel structures used for electroforming such components is shown in FIG. 1 (Prior Art). The process begins with a commercially available dielectric substrate 102 such as a silicon dioxide wafer (FIG. 1A). As is known in the art, such wafers have a highly polished, flat surface 104. To insure proper adhesion, the surface 104 is cleaned and then a thinfilm of metal 106 is deposited across the surface 104, forming a new surface 108 (FIG. 1B). A dielectric film, such as silicon nitride 110, is deposited on the surface 108 of the metal layer 106 (FIG. 1C). Next, the silicon nitride layer 108 is masked to a desired pattern and etched (FIG. 1D). The patterned structure, for example, ring-shaped pillars 116, can now serve as a mandrel structure 112 for forming a workpiece. As shown in FIG. 1E, a metal workpiece 114 is electroformed on the surface of the metal layer 106. During electroforming, metal is deposited onto the conductive areas of the structure; that is, onto the metal layer surface 108, but not onto dielectric ring pillars 116. However, as the deposited metal thickness increases, the metal flows and partially plates over the dielectric pillars 116. When the workpiece 114 reaches the predetermined proper thickness or proper dimensions, the plating is stopped and the electroformed workpiece 114 is removed from the mandrel structure 112 (FIG. 1F). In actual practice, a plurality of workpieces are formed on each substrate.

There are several drawbacks to using the mandrel structure 112 formed by this conventional process. Any defects in the dielectric layer, such as a stray particle, a pinhole, or any edge roughness in the pattern, will replicate as a defect in the electroformed workpiece 114. In fact, the electroforming process will inherently magnify any defect of the mandrel in the workpiece 114.

Another problem is that if the pillar size is fixed or otherwise constrained in size by the need to achieve a certain packing density, the electroform thickness and the dimensions of the electroformed part can not be controlled independently. The final shape of the workpiece is controlled by the physics of the electroforming steps of the process.

Generally, such methods of forming pillars of a dielectric as shown in FIG. 1D require critical alignment for the exposure process. If a second exposure process for forming the pillars is used, the alignment between these two features is critical. Thus, variations of such processes may call for more than one such critical alignment. Even small errors can negatively impact the electroforming process yield since many components are formed on one wafer.

Examples of other processes are disclosed in U.S. Pat. Nos. 4,773,971 (Lam et. al.)(assigned to the common assignee of the present invention), 4,954,225 and 4,839,001 (Bakewell) and 4,229,265 (Kenworthy).

Therefore, there is a need for an improved thin-film process to form thin-film structures such as a mandrel structure or pattern of mandrels.

SUMMARY OF THE INVENTION

In its basic aspects, the present invention provides a process for fabricating a thin-film structure. A conductive material layer is formed on a first surface of a transparent substrate. A first structure is formed of a dielectric material on the conductive material layer. The next steps include removing the conductive material layer from the first surface in a region substantially subjacent a portion of the first structure to uncover the first surface at the region. A second structure of a photoresist material on the first surface of the transparent substrate in the region by exposing the photoresist material through the transparent substrate in the region. The combination of the two structures can be used, for example, as a mandrel for electroforming ink-jet pen components.

It is an advantage of the present invention that critical thin film structure dimensions and alignments are controlled by controlling a first pattern in the formation process.

It is another advantage of the present invention that the location of thin film structures are self-aligning by use of a dielectric pattern formed in the process.

It is yet another advantage of the present invention that it is tolerant of defects in a surface or in an edge of a dielectric thin-film structure.

It is an advantage of the present invention that it provides a mandrel structure which is reusable.

It is an advantage of the present invention that the final shape of a workpiece can be controlled by the predetermined shaping of mandrel pillars firmed in accordance with the disclosed process.

It is yet another advantage of the present invention that the shape of thin film mandrel pillars can be controlled by predetermined shaping of dielectric thin film elements.

Other objects, features and advantages of the present invention will become apparent upon consideration of the following detailed description and the accompanying drawings, in which like reference designations represent like features throughout the FIG.S.

DESCRIPTION OF THE DRAWINGS

FIG. 1 (Prior Art), incorporating FIGS. 1A through 1F, is a schematic depiction of a process for forming a thin-film mandrel structure and a workpiece.

The drawings referred to in this description should be understood as not being drawn to scale except if specifically noted.

DETAILED DESCRIPTION OF THE INVENTION

Reference is made now in detail to a specific embodiment of the present invention which illustrates the best mode presently contemplated by the inventor(s) for practicing the invention. Alternative embodiments are also briefly described as applicable. The process steps described herein are performed with commercial thin-film fabrication apparatus and tools. Therefore, certain specifications will be dependent on the make and model of the equipment employed and the design of the thin film structure to be achieved. As specifically necessary to an understanding of the present invention, exemplary technical data are set forth based upon current technology. Future developments in this art and design expedients may call for appropriate adjustments as would be obvious to one skilled in the art.

Figure 2A:
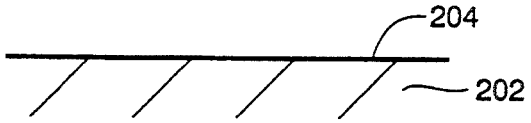
FIGS. 2A through 2S, is a schematic depiction (cross-sectional) of a process for forming a thin-film mandrel structure and workpiece in accordance with the present invention.
Figure 2B:
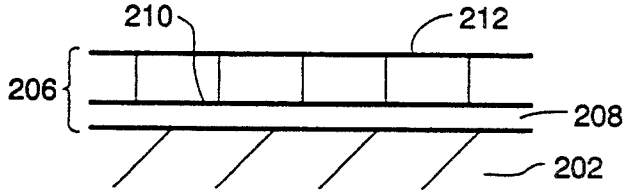
FIG. 2, incorporating
Figure 2C:
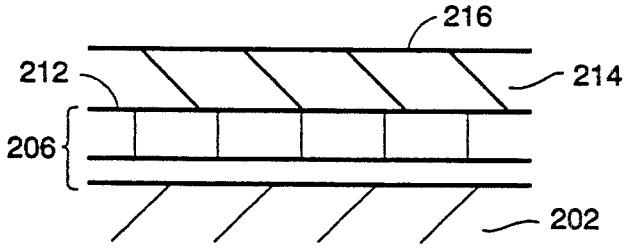
Figure 2D:
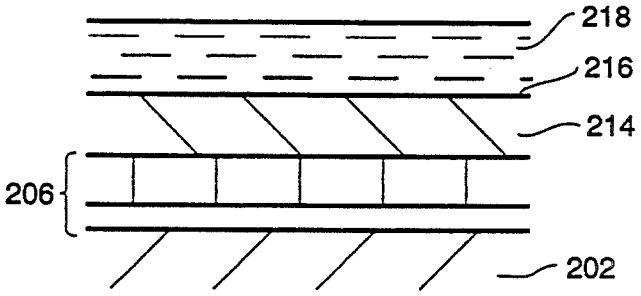
Figure 2E:
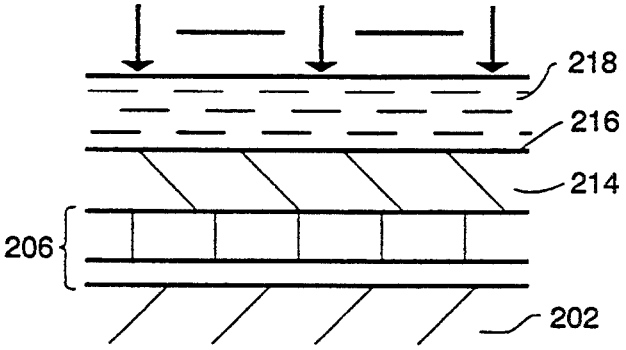
Figure 2F:
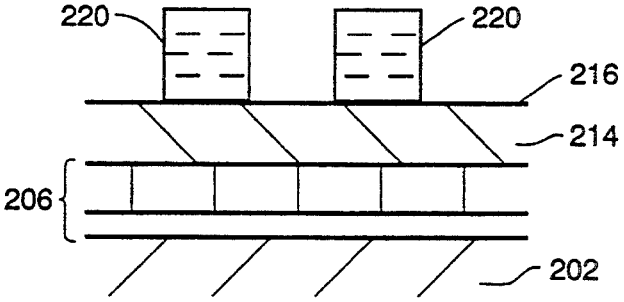
Figure 2G:
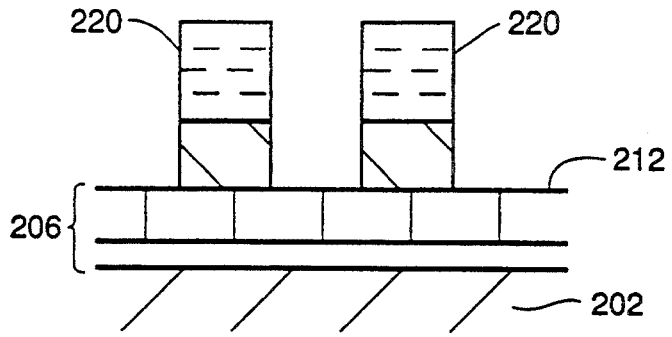
Figure 2H:
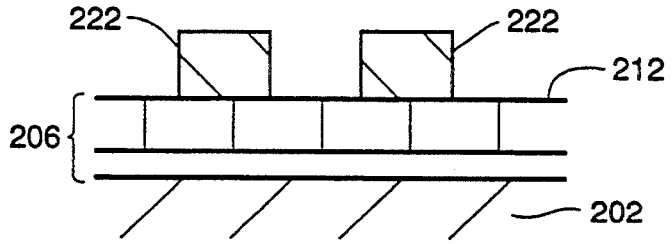
Figure 2I:
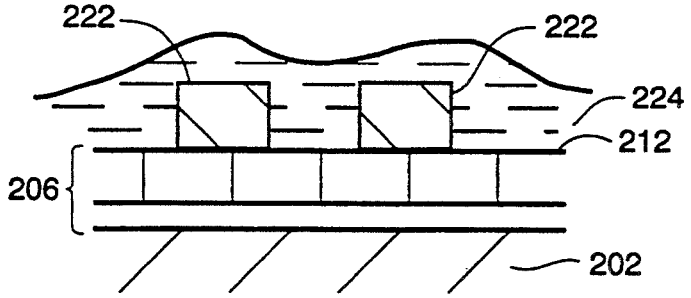
Figure 2J:
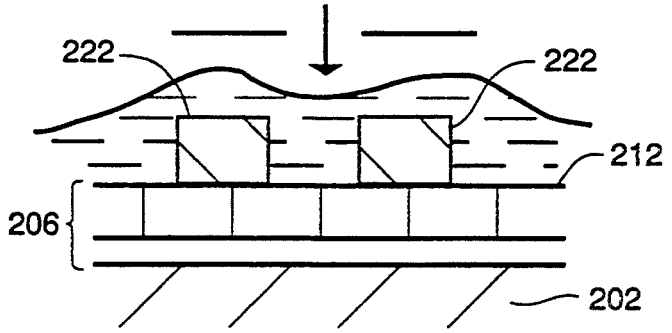
Figure 2K:
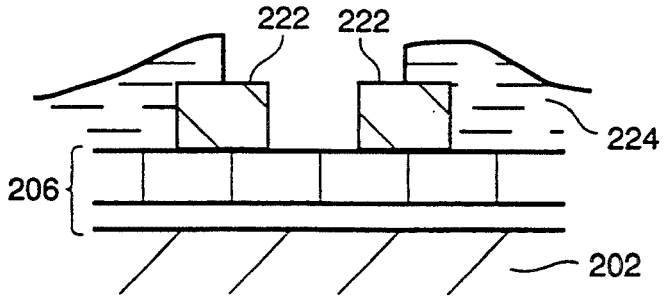
Figure 2L:
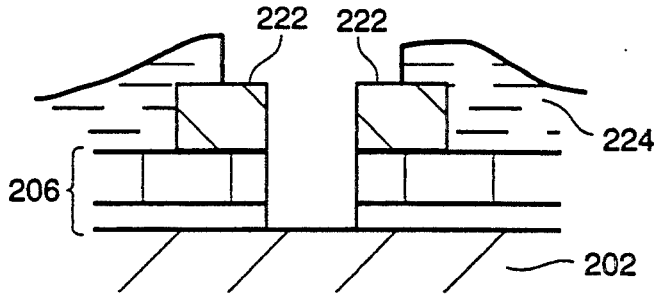
Figure 2M:
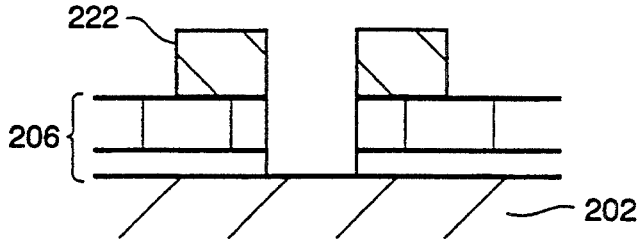
Figure 2N:
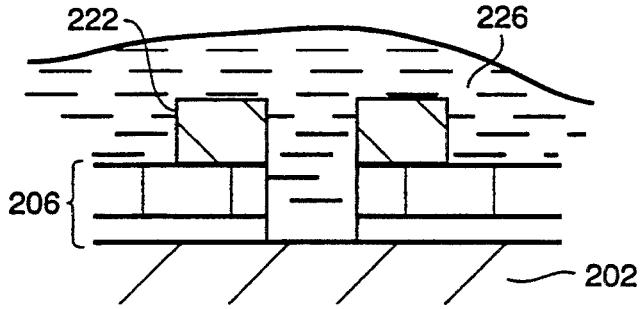
Figure 2P:
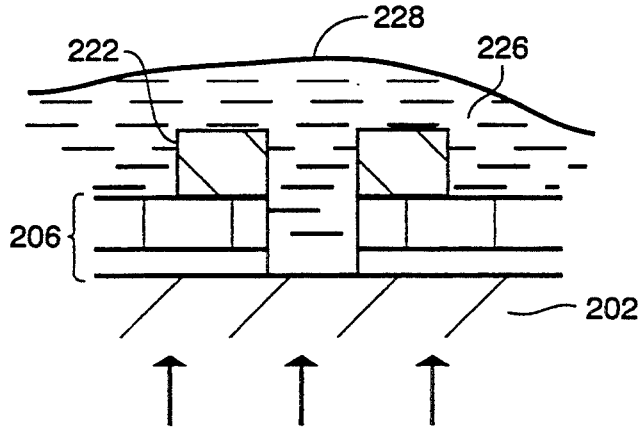
Figure 2Q:
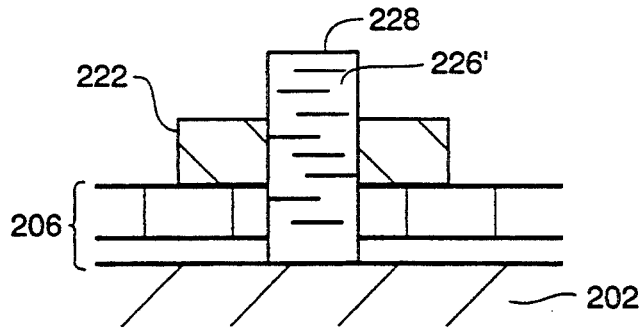
Figure 2R:
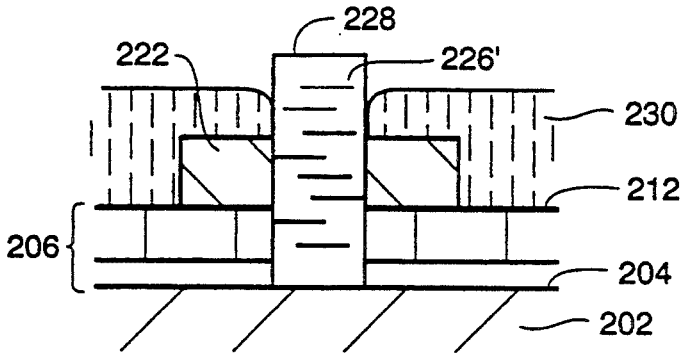
Figure 2S:
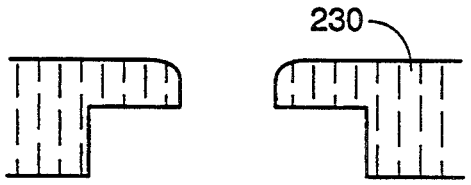
Figure 3:
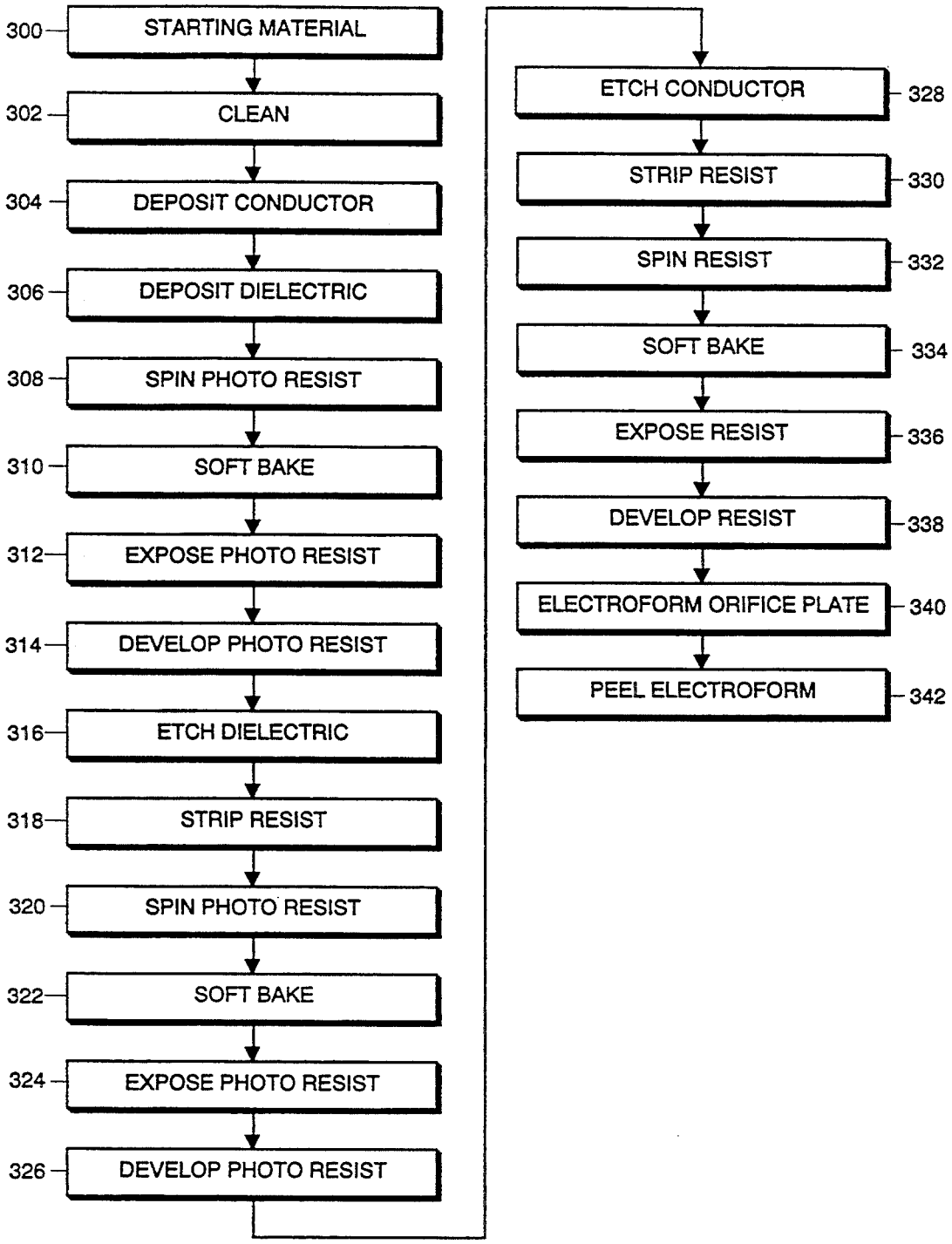
FIG. 3 is a flow chart of the process steps in accordance with the present invention as shown in FIG. 2.

Referring to FIGS. 2 and 3, the process begins 300 with a starting material substrate 202 having a polished, substantially flat surface 204 as depicted in FIG. 2A. An additional requirement is that the substrate 202 be transparent. Therefore, a glass such as soda-lime or borosilicate glass is used. (For the purpose of the disclosure of this preferred embodiment, "transparent" means for wavelengths required to expose a photoresist #3, typically wavelengths longer than 350 nanometers; however, this factor will be process dependent and thus there may be variations based upon the materials employed.)

Generally, as is known in the art, the process is performed in a clean room environment. The substrate 202 is cleaned 302. Cleaning is dependent upon the quality of the commercial substrate used. For example, for a thorough cleaning, a solution such as a sulfuric acid-hydrogen peroxide mixture is followed by a mixture of isopropyl alcohol, ammonium hydroxide, and de-ionized water. The cleaning period should be sufficient, e.g., ten minutes in each bath, to insure all imperfections, dust, and the like, have been removed from the substrate surface 204. Other solutions for cleaning the substrate and other techniques generally known in the art (such as ultrasonic scrubbing) can be employed.

As shown in FIG. 2B, a conductive layer 206 is then deposited 304 on the cleaned substrate surface 204. In the preferred embodiment, a sputtering process is used to deposit a layer of conductive material such as chrome metal 208 having a thickness in the range of 800 to 1000 Angstroms. The layer of chrome 208 is then overlaid with a layer of stainless steel 210 having a thickness in the range of 3000 to 5000 Angstroms. The metals form a new, conductive surface 212.

Next, as shown in FIG. 2C, using a plasma-enhanced chemical vapor deposition ("PECVD"), a dielectric layer 214 is deposited 306 on surface 212 of the conductive layer 206. For example, a layer 214 of silicon nitride having a thickness in the range of 2500 to 3500 Angstroms is deposited. The layer 214 of dielectric material will be used essentially to form a first pattern for the thin-film structures desired. For example, in the fabrication of ink-jet nozzle plates, two rows of small orifices effectively spaced at 1/3001th inch may be electroformed on a surface bearing a plurality of mandrels. The first pattern can be designed to produce appropriate shapes, dimensions and spacing for the nozzle plate. Similarly, the pattern can be predetermined for forming fine mesh ink filters. While other structures besides a plurality of mandrels can be fabricated in accordance with the present invention, the following steps are described with respect to an exemplary embodiment to be used as a mandrel construct for electroforming an ink-jet pen component thereon. No limitation on the scope of the invention is intended by the inventor nor should any be implied.

Referring now to FIG. 2D, a layer of photoresist 218 (such as AZ1518 by Hoechst company), approximately two microns thick, is applied 308 onto the surface 216 of the dielectric layer 214. After baking 310, the resist 218 is photographically exposed 312 (as depicted in FIG. 2E) and developed 314 in place to provide a resist pattern 220 in accordance with the desired structure on the surface 216 of the dielectric layer 214 as depicted in FIG. 2F.

Now referring to FIG. 2G, with the photoresist pattern 220 in place, using an etch chemistry (for example, sulphur-hexiflouride), the unexposed photoresist 220 and the dielectric layer 214 is plasma etched 316 from surface 212 of the metal layer 201. The remaining unexposed photoresist 220 is then stripped 318, leaving dielectric constructs 222 as shown in FIG. 2H. The constructs 222, for example, may comprise rings which will support a mandrel pillar (to be formed in steps of the process described hereinafter) through the center apertures of each the rings. In other words, in the exemplary embodiment, the aperture is sized to conform to the desired orifice diameter of a nozzle plate or aperture sizes of an ink filter to be electroformed on the mandrel pillars yet to be formed.

As depicted in FIG. 2I, in a similar manner as the previous masking steps, a second layer of photoresist 224 is applied 320 onto the surface of the metal layer 212, covering the constructs 222. After baking 322, exposing 324 (FIG. 2J), and developing 326 the second photoresist layer 224 (FIG. 2K), the conductor layer 206 is etched 328 (FIG. 2L). For the exemplary embodiment of forming a mandrel for an ink-jet pen nozzle plate, the photoresist layer 224 is patterned to form a full mask of the metal layer 206 to conform to orifice placement, shape and dimensions.

The photoresist layer 224 is not conformed during development to the inner edges 226 of the dielectric constructs 222. A slower chemical etch 328 of the conductor layer 206 is performed using this double mask. The conductor layer 206 can be etched down to the surface 204 of the substrate 202 as depicted in FIG. 2M to achieve a desired pattern before the chemicals affect the dielectric constructs 222. The exposed photoresist layer remnant is then stripped 330. In this manner, the combination of the etched conductive layer 206 and the dielectric constructs 222 form a mold region on the substrate surface 204 to be used in following steps of the process.

A third layer of photoresist 226 is applied 332 onto and baked 334 over the surface of the structure as shown in FIG. 2N. Note that this third layer is of a different type than the first two, e.g., negative versus positive resist, such as commercially available SC900 by OCG company.

The third photoresist layer 226 is now exposed 336. However, rather than masking the top surface 228 of the photoresist layer 226, the photoresist is exposed through the transparent substrate 202 as depicted in FIG. 2P. Now when the photoresist layer is developed 338, a photoresist pillar 226′ remains as shown in FIG. 2Q. Note that in the process of the present invention, these mandrel pillars 226′ are self-aligned.

The mandrel construct is now ready for electroforming 340 of a workpiece. As shown in FIG. 2R, the workpiece 230 is formed by electroplating a metal to the surface 212 of the metal layer 206. The mandrel pillars 226′ extending from the substrate surface 204 through the dielectric ring constructs 222 act as a barrier during the electroforming of workpiece 230. This barrier has been patterned by the previous steps in accordance with the predetermined design of the workpiece 230. When the electroforming process is finished, the workpiece 230 is peeled 342 from the mandrel.

In the exemplary embodiment of an ink-jet pen nozzle plate, the mandrel construct is plated with a nickel compound. The final shape of the electroformed workpiece 230, that is, the cross-sectional shape of the orifices of the nozzle plate, will be controlled by the shape of the mandrel pillars 226′. Moreover, the final dimensions of the electroformed workpiece 230, that is, the dimensions of the orifices of the nozzle plate, are also controlled independently of shape over a range established by the height of the pillars 226′.

Defects in the dielectric or in the edge of the dielectric pattern are no longer replicated in the workpiece 230. A mandrel construct fabricated in accordance with the present invention is reusable and should exhibit longevity substantially exceeding that fabricated in accordance with the prior art. The interdependency and limitations on the electroform thickness and the dimensions of the workpiece 230 as prevalent in the prior art is eliminated. With such problems eliminated, a relatively large increase of the packing density can be achieved. That is, in the exemplary embodiment disclosed, the spacing of orifices in an ink-jet pen nozzle plate, can be greatly reduced and the bore diameter held to tighter tolerances. This results in the ability to increase the DPI density on a print medium, thus increasing print quality.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this an. Similarly, any process steps described might be interchangeable with other steps in order to achieve the same result. The embodiment was chosen and described in order to best explain the principles of the invention and is best mode practical application to thereby enable others skilled in the an to understand the invention for various embodiments and with various modifications as are suited to the particular use contemplated. It is intended that the scope of the invention be defined by the claims appended hereto and their equivalents.

What is claimed is:

1. A process for fabricating a thin-film structure, comprising:
   a. forming a conductive material layer on a first surface of a transparent substrate;
   b. forming a first construct of a dielectric material on said conductive material layer;
   c. removing said conductive material layer from said first surface in a region substantially adjacent at least a portion of said first construct to uncover said first surface at said region; and
   d. forming a second construct of a photoresist material on said first surface of said transparent substrate in said region by exposing said photoresist material through said transparent substrate in said region.

2. The process as set forth in claim 1 wherein said step of forming a second construct further comprises:
   using said first construct to align said second construct.

3. The process as set forth in claim 1, wherein said step of forming a conductive material layer on a first surface of a transparent substrate comprises:
   sputtering a metal onto said transparent substrate.

4. The process as set forth in claim 1, wherein said step of forming a conductive material layer on a first surface of a transparent substrate comprises:
   a. forming a layer of chrome on said first surface; and
   b. forming a layer of stainless steel on said layer of chrome.

5. The process as set forth in claim 1, wherein said step of forming a first construct of a dielectric material on said conductive material layer comprises:
   a. depositing a dielectric material layer onto said conductive material layer;
   b. forming a photoresist material layer on said dielectric material layer;
   c. processing said photoresist material layer to form a first pattern of a plurality of substantially ring-shaped structures; and
   d. removing portions of said dielectric material layer in conformance to said first pattern such that said conductive material layer bears a superadjacent plurality of said structures.

6. The process as set forth in claim 5, where said step of removing said conductive material layer from said first surface comprises:

a. forming a photoresist material layer covering said conductive material layer, including said ring-shaped structures;

b. processing said photoresist material to form a second pattern conforming to a substantially central region of each said ring-shaped structures;

c. removing said conductive material layer in conformance to said second pattern such that each said ring-shaped structure forms a central recess extending from said first surface of said transparent substrate.

7. The process as set forth in claim 6, wherein said step of forming a second construct of a photoresist material on said first surface of said transparent substrate comprises:

a. forming a photoresist material layer covering said ring-shaped structures and filling said recesses;

b. exposing said resist through said transparent material substrate such that only photoresist material within and superjacent said recesses is exposed; and c. processing said photoresist material such that said first and second constructs form a plurality of said thin-film structures on said conductive material surface.

8. The process as set forth in claim 7, wherein said step of processing said photoresist material comprises:

forming a plurality of thin-film mandrels for fabricating inkjet pen nozzle plates.

9. The process as set forth in claim 7, wherein said step of processing said photoresist material comprises:

forming a plurality of thin-film mandrels for fabricating inkjet pen ink filter screens.

10. A method for fabricating a thin-film mandrel structure on a substrate having the property of transparency, comprising:

a. forming a conductive layer on a first surface of said substrate;

b. forming a mandrel first portion fabricated of a dielectric material on said conductive layer;

c. masking and etching said conductive layer using said mandrel first portion as a partial mask to form said mandrel first portion and said conductive layer into a molding means for forming another portion of said mandrel structure, such that said molding means has a predetermined shape and dimensions;

d. depositing a layer of photoresist material superjacent said molding means;

e. exposing said photoresist material through said transparent substrate; and f. forming a mandrel second portion of said photoresist material within and extending beyond said molding means such that said mandrel structure conforms to said predetermined shape and dimensions.

11. The method as set forth in claim 10, wherein said step of forming a mandrel first portion fabricated of a dielectric material on said conductive layer comprises:

a. depositing a layer of dielectric material across said conductive layer;

b. forming a layer of photoresist on said dielectric layer;

c. masking said photoresist with a first predetermined pattern for forming a plurality of mandrel first portions;

d. exposing said photoresist;

e. developing said photoresist to form a mask having said first predetermined pattern on said dielectric material;

f. etching said dielectric material to form a conformingly patterned dielectric material; and g. stripping said mask from said patterned dielectric material, whereby a plurality of mandrel first portions superpose said conductive layer.

12. The method as set forth in claim 11, wherein said step of masking and etching said conductive layer comprises:

a. forming a layer of photoresist covering said plurality of mandrel first portions and exposed conductive layer regions;

b. masking said photoresist with a second predetermined pattern for forming a plurality of mandrel second portions;

c. exposing said photoresist;

d. developing said photoresist to form a mask having said second predetermined pattern on said mandrel first portions and said layer of conductive material;

e. etching said conductive material to form a conformingly patterned conductive material such that said mandrel first portions and said patterned conductive material form a means for forming mandrel second portions; and f. stripping said mask.

13. The method as set forth in claim 12, wherein said step of forming a mandrel second portion of said photoresist material comprises:

a. exposing said photoresist layer through said substrate such that only photoresist material conformed to said pattern for said means for forming mandrel second portions is exposed; and b. developing said photoresist material such that said mandrel second portions are formed of remaining exposed photoresist material.

14. The method as set forth in claim 10, further comprising:

forming a plurality of said thin-film mandrel structures on said substrate having a predetermined shape, dimensions and spacing for forming an inkjet pen nozzle plate thereon.

15. The method as set forth in claim 10, further comprising:

forming a plurality of said thin-film mandrel structures on said substrate having a predetermined shape, dimensions and spacing for forming an ink:-jet pen ink filter screen thereon.

16. A method for fabricating an ink-jet pen component having a plurality of orifices of predetermined shape and predetermined dimensions at a predetermined spacing on said pen component, comprising:

a. forming a conductive layer on a first surface of a transparent substrate;

b. forming a plurality of dielectric constructs on said conductive layer having a pattern conforming to said predetermined shape, dimensions and spacing;

c. removing a portion of said conductive layer from said first surface conforming to said pattern; and d. forming a second construct of a photoresist material on said first surface of said transparent substrate by exposing said photoresist material through said transparent substrate in said region such that said first and second constructs conform to said predetermined shape, dimensions and spacing; and e. forming said pen component using said first and second constructs as a mandrel structure.

17. The method as set forth in claim 16, wherein said step of forming a conductive material layer on a first surface of a transparent substrate comprises:

sputtering a metal film onto said transparent substrate.

18. The method as set forth in claim 17, wherein said step of sputtering a metal film comprises:

a. forming a layer of chrome on said first surface having a thickness in the range of approximately 800 to 1000 Angstroms; and b. forming a layer of stainless steel on said layer of chrome having a thickness in the range of approximately 3000–5000 Angstroms.

19. The method as set forth in claim 16, wherein said step of forming a plurality of dielectric constructs on said conductive layer comprises:

1. forming a layer of dielectric material superposing said conductive layer;

b. covering said layer of dielectric material with a layer of photoresist material;

c. masking said layer photoresist material to form a pattern for a plurality of ring-shaped structures;

d. exposing said photoresist material;

e. developing said photoresist material to remove exposed regions of said photoresist material;

f. etching said dielectric layer to remove unmasked regions; and g. stripping exposed regions of said photoresist material, whereby a plurality of ring-shaped structures of dielectric material remain on said conductive layer.

20. The method as set forth in claim 19, wherein said step of removing a portion of said conductive layer from said first surface conforming to said pattern comprises:

a. covering said conductive layer and said ring structures with a layer of photoresist material;

b. masking said layer of photoresist material such that only a predetermined region central to said ring-shaped structures is exposed;

c. exposing said photoresist material;

d. developing said photoresist material to remove photoresist material said predetermined region;

e. etching said conductive layer down to said first surface; and f. stripping said layer of photoresist material.

21. The method as set forth in claim 2,0, wherein said step of forming a second construct of a photoresist material on said first surface of said transparent substrate comprises:

a. covering said conductive layer, said ring structures, and said exposed first surface of said transparent substrate with a layer of photoresist material such that said layer of photoresist material has a predetermined height dimension from said first surface of said substrate which is greater than the height dimension of said ring-shaped structures;

b. exposing said photoresist material through said transparent substrate such that only photoresist material in said predetermined region central to said ring-shaped structures is exposed;

c. developing said photoresist material to remove all unexposed regions, such that said exposed photoresist material forms a pillar central to said ring-shaped structures.

22. The method as set forth in claim 21, wherein said step of forming said pen component comprises:

a. electroforming a pen component onto said conductive layer such that said first and second constructs act as orifice mandrels; and b. peeling said pen component from said metal layer.

* * * * *